US009134643B2

(12) United States Patent
Kihara et al.

(10) Patent No.: US 9,134,643 B2
(45) Date of Patent: Sep. 15, 2015

(54) IMAGE FORMING APPARATUS INCLUDING CONTROL UNIT FOR CONTROLLING CHARGING BIAS AND LASER POWER

(71) Applicant: CANON KABUSHIKI KAISHA, Tokyo (JP)

(72) Inventors: Takayoshi Kihara, Mishima (JP); Motoki Adachi, Ashigarakami-gun (JP); Hideaki Hasegawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 13/866,778

(22) Filed: Apr. 19, 2013

(65) Prior Publication Data

US 2013/0279927 A1 Oct. 24, 2013

(30) Foreign Application Priority Data

Apr. 24, 2012 (JP) ..... 2012-098871

(51) Int. Cl.

| | |
|---|---|
| ***G03G 15/02*** | (2006.01) |
| ***G03G 15/047*** | (2006.01) |
| ***G03G 15/043*** | (2006.01) |
| *G03G 15/01* | (2006.01) |

(52) U.S. Cl.

CPC ..... *G03G 15/0266* (2013.01); *G03G 15/043* (2013.01); *G03G 15/047* (2013.01); *G03G 15/011* (2013.01)

(58) Field of Classification Search

CPC ..... G03G 15/0266; G03G 15/0283; G03G 15/043; G03G 15/045; G03G 15/047; G03G 15/011

USPC ..... 399/26, 43, 50, 51

See application file for complete search history.

(56) References Cited

U.S. PATENT DOCUMENTS

| | | | | |
|---|---|---|---|---|
| 7,433,615 | B2 * | 10/2008 | Murakami et al. | 399/49 |
| 7,783,212 | B2 * | 8/2010 | Ichikawa et al. | 399/48 |
| 2004/0141766 | A1 | 7/2004 | Toyama | |
| 2009/0300009 | A1 * | 12/2009 | Rezaei et al. | 707/5 |
| 2012/0230705 | A1 * | 9/2012 | Shimura et al. | 399/26 |

FOREIGN PATENT DOCUMENTS

| | | | |
|---|---|---|---|
| JP | H06-202435 | A | 7/1994 |
| JP | 8-171260 | A | 7/1996 |
| JP | 2002-296853 | A | 10/2002 |
| JP | 2002-296853 | A | 10/2002 |
| JP | 2004-151612 | A | 5/2004 |
| JP | 2007304523 | A * | 11/2007 |
| JP | 2011-081122 | A | 7/2011 |
| JP | 2012-037662 | A | 2/2012 |

* cited by examiner

*Primary Examiner* — Robert Beatty

(74) *Attorney, Agent, or Firm* — Canon USA, Inc., IP Division

(57) ABSTRACT

The image forming apparatus is capable of executing a color mode for forming images of a plurality of colors using the plurality of developer bearing members, and a mono-mode for forming images of mono color using one developer bearing member of the plurality of developer bearing members. The control unit, when the color mode is executed, determines the charging bias and, the first laser power and the second laser power for respective image bearing members, based on information about the plurality of image bearing members. The control unit, when the mono-mode is executed, determines the charging bias and, the first laser power and the second laser power to image bearing member for mono-mode, based on information about image bearing member for mono-mode.

12 Claims, 7 Drawing Sheets

IMAGE FORMING APPARATUS INCLUDING CONTROL UNIT FOR CONTROLLING CHARGING BIAS AND LASER POWER

BACKGROUND OF THE INVENTION

1. Field of the Invention

The present disclosure relates to an image forming apparatus.

2. Description of the Related Art

Conventionally, an electrophotographic image forming apparatus employing what is called contact charging process has been put to practical use, which has advantages such as low ozone, and low electric power. The contact charging process involves application of voltages on a charging roller serving as a charging member which contacts a photosensitive member serving as an image bearing member, thereby charging a surface of the photosensitive member. Furthermore, in recent years, from viewpoint of low costs, and space-saving, there is employed DC charging process using a charging roller to which only direct current (DC) voltage is applied.

In the DC charging process, there is a problem that uniformity of charging is insufficient. In the contact charging process, there is a problem that a surface potential of the photosensitive member rises when a film thickness of the surface of the photosensitive member decreases along with frequent use of the photosensitive member.

In order to solve these problems, there is known an exposure method of overcharging once the surface potential of the photosensitive member to equal to or greater than an electric potential necessary for image formation, after that, irradiating with weakly emitted laser light, a non-image region where image formation on the surface of the photosensitive member is not performed, thereby lowering the potential. This method is called "background exposure" (Refer to Japanese Patent Application Laid-Open No. 8-171260). Further, Japanese Patent Application Laid-Open No. 2002-296853 discusses a control method for forming a surface potential of the photosensitive member to be a targeted potential by calculating a film thickness of the photosensitive member, and controlling a laser power of the laser light. By performing such a control, image density, line width, and gradation can be stably reproduced On the other hand, in the above-described electrophotographic image forming apparatus, as a process for forming a color image, a color image formation process what is called a tandem type is commonly used. In an image forming apparatus of the tandem type, toner images of respective colors of yellow, magenta, cyan, and black are formed on the photosensitive members. Then, in the image forming apparatus of such a tandem type, process units such as a charging device and a development device each are individually arranged on each of the photosensitive members that form the toner images of the respective colors.

In the image forming apparatus of the tandem type that enables image formation of a plurality of colors as described above, a configuration of sharing as much as possible a power source for each of the charging unit, and development unit is preferred, from viewpoint of reduction of size, and reduction of cost. However, in the image forming apparatus of the DC charging process in which the power source is shared, a predetermined charging potential is constantly formed on all the photosensitive members, and light sensitivity can worsen in some cases resulting from a light fatigue of the photosensitive members. Therefore, improvement to reduce worsening of the light sensitivity due to the light fatigue of the photosensitive members needs to be made. Further, in order to perform background exposure, it is necessary to change the surface of the photosensitive member to a desired potential by a predetermined laser power, and a light source as an exposure unit is easily exhausted, and therefore improvement needs to be made from viewpoint of service life extension

SUMMARY OF THE INVENTION

The present disclosure is directed to reducing a laser power generated by an exposure device, and inhibiting deterioration of an image bearing member.

According to an aspect disclosed herein, an image forming apparatus that forms an image on a recording material includes a plurality of image bearing members, a plurality of charging devices configured to charge a corresponding image bearing member, by the same charging bias supplied from a mutually shared first power source, and to form a predetermined charging potential on a surface of the image bearing member, an exposure device configured to expose with a first laser power a non-image region to which a developer is not supplied from a developer bearing member, of a surface of the image bearing member to generate a non-image region potential, and to expose with a second laser power greater than a first laser power an image region to which developer is supplied from the developer bearing member to generate an image region potential, a plurality of developer bearing members configured to supply a developer to an image region of a corresponding image bearing member, on a surface of which a predetermined development potential is formed, by the same development bias supplied from a mutually shared second power source, a storage device configured to acquire and store information about the plurality of image bearing members, and a control unit configured to control the charging bias and the first laser power and the second laser power for respective image bearing members. The image forming apparatus is capable of executing a color mode for forming images of a plurality of colors using the plurality of developer bearing members, and a mono-mode for forming images of mono color using one developer bearing member of the plurality of developer bearing members. The control unit, when the color mode is executed, determines the charging bias and, the first laser power and the second laser power for respective image bearing members, based on information about the plurality of image bearing members. The control unit, when the mono-mode is executed, determines the charging bias and, the first laser power and the second laser power for image bearing member for mono-mode, based on information about image bearing member for mono-mode.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects will be described in detail below with reference to the drawings.

Figure 1:
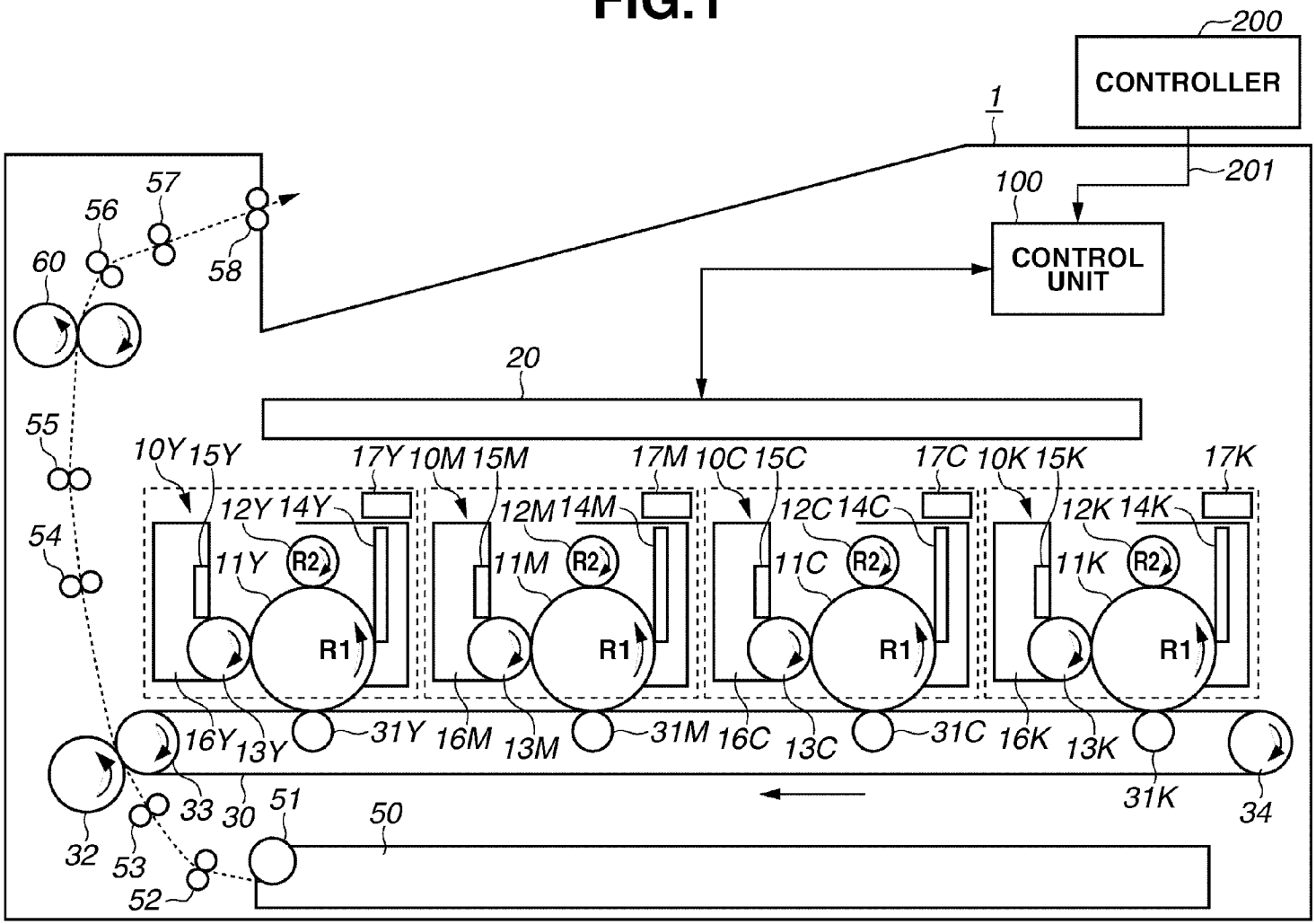
FIG. 1 is a schematic cross-sectional view of a general configuration of an image forming apparatus according to a first exemplary embodiment.

A general configuration of a laser beam printer employing an electrophotographic process which is an embodiment of an image forming apparatus according to a first exemplary embodiment will be described with reference to FIG. 1. FIG. 1 is a schematic cross-sectional view of the general configuration of the image forming apparatus according to the first exemplary embodiment.

As illustrated in FIG. 1, in the first exemplary embodiment, an image forming apparatus main body 1 is provided with a printer control unit (hereinafter, simply referred to as a control unit) 100. The control unit 100 is a unit that controls an operation of the image forming apparatus, and delivers and receives various types of electrical information signals to and from a printer controller (hereinafter, simply referred to as a controller) 200 connected via an interface 201. Further, the control unit 100 controls processing of electrical information signals input from various types of process devices or sensors, processing of command signals to various types of process devices, a predetermined initial sequence control, and a predetermined image formation sequence. Then, the image forming apparatus according to the first exemplary embodiment forms images corresponding to image data (electrical image information) input from the controller 200 on a paper P as a recording material, and outputs image formation product. The controller 200 is a host computer, a network, an image reader, a facsimile or the like. The recording material may be not only paper, but also over head projector (OHP) sheet, post card, envelope, label or the like.

Furthermore, respective components, with which the image forming apparatus according to the first exemplary embodiment is provided, will be described. As illustrated in FIG. 1, the image forming apparatus according to the first exemplary embodiment is provided with, as main components, a laser exposure unit 20 as an exposure unit (exposure device), an intermediate transfer belt 30, primary transfer rollers 31, a secondary transfer roller 32, and a fixing device 60. Further, the image forming apparatus according to the first exemplary embodiment is configured of what is called a tandem type in which a plurality of process cartridges 10 that enables image formation with respect to four colors (a plurality of colors) of yellow (Y), magenta (M), cyan (C), and black (K) are arrayed in substantially horizontal direction at a predetermined interval. These four process cartridges have the same configuration except that colors of image formation are different from each other, and are configured such that a cleaning unit and a development unit (development device) are integrally assembled into cartridge. The respective process cartridges are configured detachably at respective image stations provided in the image forming apparatus main body 1, corresponding to respective process cartridges. Then, for example, when the toner contained in the development unit is consumed, the toner can be replenished by individually replacing the process cartridge. Hereinbelow, descriptions will be given by attaching subscripts Y, M, C, and K to reference numerals to represent that each component is provided for each color, but if such differentiation is not necessary, descriptions will be provided by omitting these subscripts.

The cleaning unit is provided with the photosensitive drum 11 as a first image bearing member, the charging roller 12 as a charging unit (charging device), and a drum cleaner 14. Further, the development unit is provided with the development roller 13 as a developer bearing member, a developer blade 15, and a toner container 16 that contains toner as developer. In the first exemplary embodiment, non-magnetic one-component toner charged to negative polarity is used as the developer.

The photosensitive drum 11 is composed of a cylindrical-shaped base substance made of aluminum, and an organic photoconductor (OPC) (organic semiconductor) photosensitive layer covering the surface. The photosensitive layer is a layer formed of a charge transport layer and the underlying charge generation layer and the like. The photosensitive drum 11 is driven to rotate by a driving unit (not illustrated) in a direction of an arrow R1 in FIG. 1 at a surface moving speed of 120 (mm/sec).

The charging roller 12 has a cored bar and a conductive elastic body layer formed concentrically and integrally around the cored bar, and charges the surface of the photosensitive drum 11. A predetermined charging bias is applied to the cored bar of the charging roller 12. Then, the charging roller 12 is arranged substantially parallel to the photosensitive drum 11, and the charging roller 12 contacts the photosensitive drum 11 with a predetermined pressing force against an elasticity of the conductive elastic body layer. In the first exemplary embodiment, what is called contact charging process is adopted. Further, both ends of the cored bar are rotatably supported by bearing (not illustrated), and the charging roller 12 is rotated in a direction of an arrow R2 in FIG. 1 driven by rotation of the photosensitive drum 11.

The laser exposure unit 20 includes a light source (laser output section) such as a laser element that outputs a laser light L (see FIG. 4) modulated in response to time-series electric digital pixel signal, a rotating multi-faceted mirror (polygon mirror), an f-θ lens, a reflection mirror, and the like. Then, main-scanning exposure is performed by deflecting and scanning the laser light L in a longitudinal direction (main-scanning direction) of the photosensitive drum 11, by rotation of the rotating polygon mirror. By the main-scanning exposure, and sub-scanning exposure by rotation of the photosensitive drum 11, the laser exposure unit 20 forms a latent electrostatic image on the photosensitive drum 11 (on the image bearing member).

The development roller 13 has a cored bar and a conductive elastic body layer formed concentrically and integrally around the cored bar, and is arranged substantially parallel to the photosensitive drum 11. Further, the developer blade 15 is formed of a thin metallic sheet made of SUS, and contacts the development roller 13 with a predetermined pressing force, thereby making the toner layer on the development roller 13 (on the developer bearing member) uniform. The development roller 13 bearing and carrying the toner supplies the toner charged to negative polarity by friction to the photosensitive drum 11 in order to develop the latent electrostatic image formed on the photosensitive drum 11.

In the first exemplary embodiment, what is called contact development process is adopted, and the development roller 13 is configured to repeat contacting and separating with respect to the photosensitive drum 11 by contacting/separating mechanism (not illustrated). Then, the development roller 13 contacts the photosensitive drum 11 during image formation step, and a predetermined development bias is applied to the cored bar of the development roller 13. On that occasion, a surface potential of the development roller 13 becomes a predetermined development potential as a development bias.

The intermediate transfer belt 30 as a second image bearing member formed in an endless shape is arranged to contact the photosensitive drums 11Y through 11K of respective process cartridges 10Y through 10K. The intermediate transfer belt 30 is formed of a resin film such as polyvinylidene difluoride (PVdf), nylon, polyethylene telephthalate (PET), polycarbonate (PC) having an electric resistance value on the order of $10^{11}$ to $10^{16}$ (Ωcm) and thickness of 100 to 200 (μm). The electric resistance value (volume resistance value) may be adjusted to provide appropriate resistance when necessary. Further, the intermediate transfer belt 30 is stretched by a drive roller 34, and a secondary transfer counter roller 33, and is driven to circulate at a process speed by rotation of the drive roller 34 driven by a motor (not illustrated).

The primary transfer roller 31, which is rotatably provided, is configured in a roller shape such that the conductive elastic body layer is provided on a rotating shaft, and is arranged substantially parallel to the photosensitive drum 11. The primary transfer roller 31 contacts the photosensitive drum 11 with a predetermined pressing force via the intermediate transfer belt 30. Further, direct current (DC) transfer bias with positive polarity is applied to the rotating shaft of the primary transfer roller 31, by a primary-transfer bias power source 701 (see FIG. 4), thereby forming primary-transfer electric-field between the primary transfer roller 31 and the photosensitive drum 11. The control unit 100 controls the DC transfer bias applied by the primary-transfer bias power source 701 to have an optimum value that takes into account environments and characteristics of parts and the like, so that the primary transfer step always satisfies the condition such as high transfer efficiency or low re-transfer rate and the transfer step is adequately carried out.

The secondary transfer roller 32, which is rotatably provided, is configured in a roller shape such that the conductive elastic body layer is provided on the rotating shaft, and contacts the secondary transfer counter roller 33 via the intermediate transfer belt 30. Then, a bias with positive polarity is applied to the rotating shaft of the secondary transfer roller 32 by a secondary-transfer bias power source 702 (see FIG. 4), using the secondary transfer counter roller 33 as a counter electrode, thereby forming secondary-transfer electric-field between the secondary transfer roller 32 and the photosensitive drum 11.

Each of the process cartridges 10 is provided with a non-contact nonvolatile memory 17 as a storage unit (storage device). The non-contact nonvolatile memory 17 has an antenna (not illustrated) serving as an information transmission unit, and communicates wirelessly with the control unit 100 on the image forming apparatus main body 1 side, and can read and write information. In the non-contact nonvolatile memory 17, information about film layer and sensitivity of the photosensitive drum 11 is stored at the time of manufacture. The non-contact nonvolatile memory 17 is configured to acquire information about change amounts of film thickness and sensitivity of the photosensitive drum 11, a number of revolutions of the development roller 13, toner consumption, and the like, which result from use of the process cartridge 10, and able to randomly write and read these pieces of information. As the storage unit, a contact nonvolatile memory, or a volatile memory having a power source may be used.

In the image forming apparatus main body 1, a paper cassette 50, a pickup roller 51, and conveyance rollers 52 through 57 are disposed, as the paper conveyance system. In the paper cassette 50, the papers P are stored. The pickup roller 51 separates and conveys the papers P stored in the paper cassette 50 one by one. The conveyance rollers 52 through 57 convey the paper P fed out by the pickup roller 51.

Next, referring to FIG. 1, an outline of an image forming operation of the image forming apparatus according to the first exemplary embodiment will be described. First, the charging roller 12 charges the surface of the photosensitive drum 11 and forms a predetermined charging potential. Then, the laser exposure unit 20 emits the laser light L, and exposes the surface of the photosensitive drum 11 and forms a latent electrostatic image. Furthermore, the development roller 13 visualizes the latent electrostatic image by supplying toner onto the photosensitive drum 11, and forms a toner image. The toner images of respective colors formed on the photosensitive drums 11 are sent to the primary-transfer positions, by the photosensitive drums 11 rotating in a direction of an arrow R1, and then are primarily transferred sequentially onto the intermediate transfer belt 30, by primary-transfer electric fields formed between the primary transfer rollers 31 and the photosensitive drums 11. At that time, since the images of four colors are sequentially transferred in superimposed manner, positions on the intermediate transfer belt 30 of the toner image of four colors coincide with each other. On that occasion, remaining toners which remain on the photosensitive drums 11 after the primary-transfer are scraped off and recovered by the drum cleaners 14.

On the other hand, the papers P as recording material are separated and conveyed one by one by the pickup roller 51 from the paper cassette 50 which stores the papers P, in synchronization with rotation of the intermediate transfer belt 30. Then, the papers P are conveyed to the secondary transfer roller 32, in synchronization with image formation operation, by the conveyance rollers 52 and 53. Then, the toner images of four colors formed on the intermediate transfer belt 30 are collectively secondarily transferred onto the paper P, by the secondary transfer electric fields formed between the secondary transfer roller 32 and the photosensitive drums 11. On that occasion, the remaining toners which remain on the intermediate transfer belt 30 after the secondary transfer are transferred to the photosensitive drums 11 side at the primary-transfer positions of the image formation step, and are scraped off and recovered by the drum cleaners 14. At this time, electric charge with positive polarity is applied to the remaining toner after the secondary transfer by a charging brush (not illustrated) applying a bias.

Furthermore, the paper P onto which the toner images of four colors have been transferred, is conveyed to the fixing device 60 by the conveyance rollers 54 and 55, and the toner images on the paper P undergo fixing processing by heat and pressure and are fixed to the paper P. Then, the paper P on which the toner image has been fixed is discharged as color image formed product by the discharge roller 58, from a sheet discharge port to a sheet discharge tray (not illustrated) arranged on the top surface of the image forming apparatus main body 1. In this way, a series of image formation operations ends.

Next, background (non-image region) exposure which forms the basis of a technique of the image forming apparatus according to the first exemplary embodiment will be described. Conventionally, there is known an exposure method for overcharging once the surface of the photosensitive member to equal to or greater than an electric potential necessary for image formation, and after that, irradiating with weakly emitted laser light L a non-image region on the surface of the photosensitive member where image formation is not performed, thereby lowering the potential. This is called background exposure. The background exposure is performed to secure uniformity of the surface potential of the photosensitive drum. In this case, in the configuration where the photosensitive drum 11 and the charging roller 12 contact each other, as in the first exemplary embodiment, the surface of the photosensitive drum 11 is scraped due to the use of the photosensitive drum 11 in the image formation operation, resulting in decrease of film thickness. If the film thickness of the surface of the photosensitive drum 11 is decreased, the surface potential of the photosensitive drum 11 rises. Therefore, the background exposure is performed by altering intensity of light emission of the laser light L from the laser exposure unit 20, based on the film thickness of the surface of the photosensitive drum 11. In the first exemplary embodiment, information about film thickness of the photosensitive drum 11 is obtained based on at least one of a number of image formations, a number of the papers P passing through the image forming apparatus, a number of revolutions of the photosensitive drum 11, and a charging time of the photosensitive drum 11 by the charging roller 12.

Latent image setting by the laser exposure unit in the first exemplary embodiment will be described in detail. In the first exemplary embodiment, the photosensitive drum 11 is composed of a cylindrical-shaped base substance made of aluminum, and an OPC (organic semiconductor) photosensitive layer covering the surface thereof, and an initial film thickness of the photosensitive layer is 20 (μm). Then, when image formation operation is initiated, a primary charging bias (DC voltage) of −1100 (V) is applied to the charging roller 12, and a primary charging potential Vd0 of −500 (V) as a predetermined charging potential is formed on the surface of the photosensitive drum 11.

The laser exposure unit 20 in the first exemplary embodiment is configured to switch output values between two levels of a first laser power E1 and a second laser power E2, as a laser power when the surface of the photosensitive drum 11 is exposed. In the control unit 100, there is provided a laser power control unit (not illustrated) that controls a laser power output from the laser exposure unit 20, corresponding to an image region where images are formed, and a non-image region where images are not formed, of the surface of the photosensitive drum 11.

The laser power control unit selects a first laser power E1 as a laser power for a dark portion potential Vd as a non-image region potential, with respect to the non-image region, and selects a second laser power E2 as a laser power for a light portion potential Vl as an image region potential. In the first exemplary embodiment, in the image formation step, the weak laser is emitted by passing a predetermined bias current through a laser diode as a laser element, and this is set as the first laser power E1. Then, in the image region, the second laser power E2 is set by passing electric current with further added electric current value. In this way, the laser powers E1 and E2 can be controlled by varying an amount of electric current which is passed through the laser diode or the like as the laser element. Not only the laser diode but also light emitting diode (LED) or the like may be used for the laser element.

Figure 2:
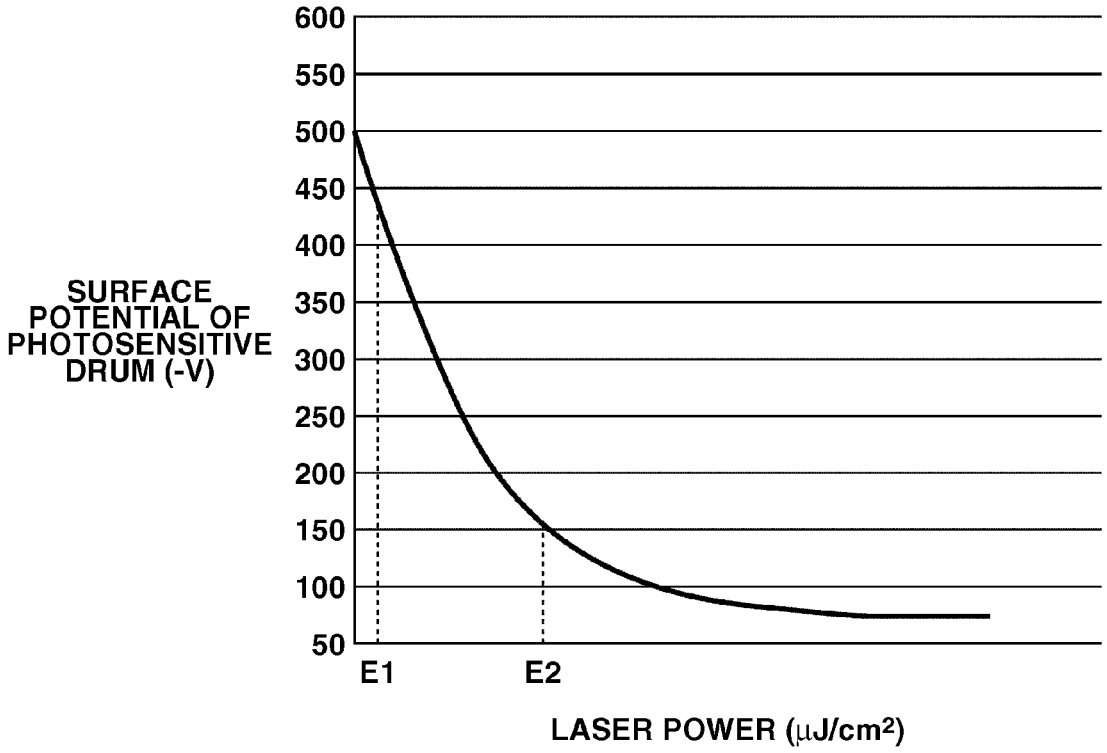
FIG. 2 is a graph illustrating a relationship between surface potential of photosensitive drum in the first exemplary embodiment and laser power.

Now, a relationship between a surface potential of the photosensitive drum and a laser power will be described with reference to FIG. 2. FIG. 2 is a graph illustrating a relationship between a photosensitive drum potential and a laser power in the first exemplary embodiment. In the graph of FIG. 2, a vertical axis represents a surface potential (−V) of the photosensitive drum 11, and a horizontal axis represents a laser power E (μJ/cm$^2$) of exposure which the surface of the photosensitive drum 11 receives. In this graph, the film thickness of the photosensitive drum 11 is 20 (μm) which is a film thickness at an initial stage of use. In the first exemplary embodiment, the laser exposure unit 20 performs exposure with the second laser power E2 (μJ/cm$^2$), on the image region of the photosensitive drum 11, thereby forming a light portion potential Vl of about −150 (V). At the same time, a dark portion potential Vd of about −450 (V) is formed by performing exposure with the first laser power E1 (μJ/cm$^2$), which is smaller than the second laser power E2, on the non-image region (background).

Figure 3:
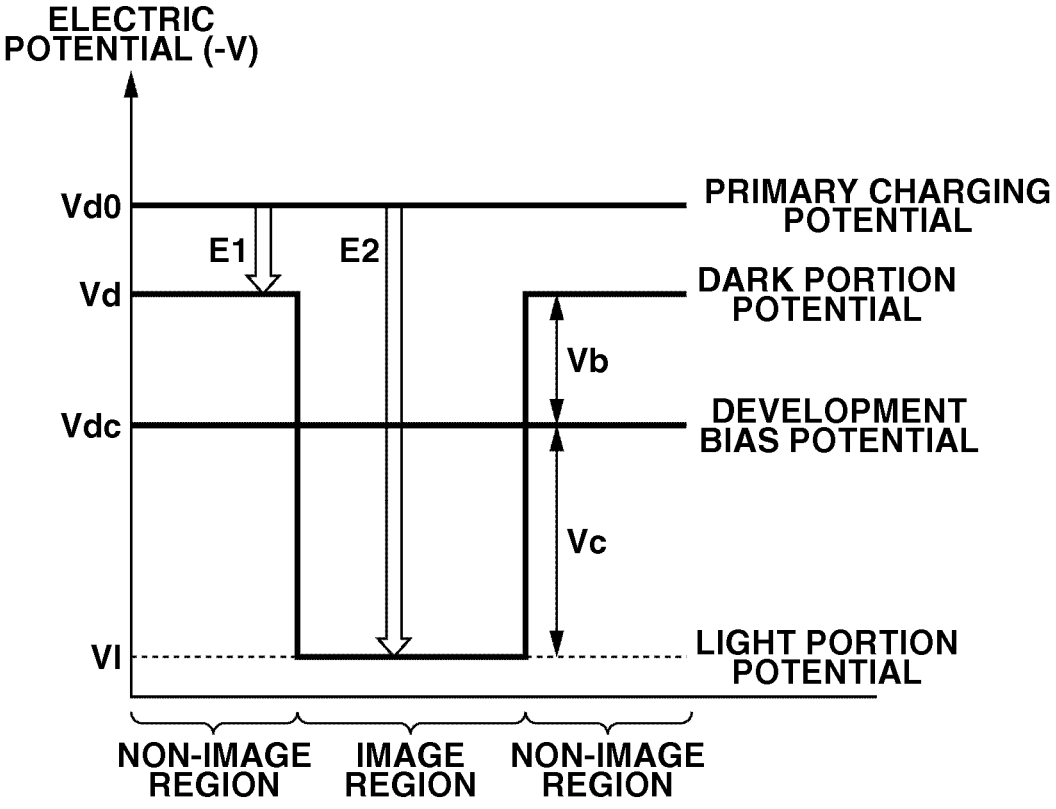
FIG. 3 is a diagram illustrating potential settings in image regions and non-image regions in the first exemplary embodiment.

Next, potential settings in the image region and the non-image region will be described with reference to FIG. 3. FIG. 3 is a graph illustrating potential settings in the image region and the non-image region, in the first exemplary embodiment. In the first exemplary embodiment, stable dark portion potential Vd which prevents charging unevenness of the surface of the photosensitive drum 11 can be formed, by weakly light emitting on the non-image region (what is called background exposure). Further, in the first exemplary embodiment, DC bias of about −300 (V) is applied to the development roller 13, and a development bias potential Vdc is formed as a development potential, on the surface of the development roller 13. For this reason, a toner charged to negative polarity by a potential difference (development contrast potential) Vc between the light portion potential Vl on the photosensitive drum 11 and the development bias potential Vdc will be supplied onto the photosensitive drum 11 from the development roller 13. Then, a latent electrostatic image formed on the photosensitive drum 11 is visualized, and thereby the toner image is formed on the photosensitive drum 11. In this way, in the first exemplary embodiment, reverse development process is carried out, in which charging of the photosensitive drum 11 by the charging roller 12 is performed with negative electric charge, and development is performed by the toner charged to negative polarity.

The development contrast potential Vc which is a potential difference between the light portion potential Vl and the development bias potential Vdc is a factor in setting an image density and gradation of the image region. In other words, as the development contrast potential Vc becomes small, sufficient image density and gradation cannot be obtained. Therefore, the development contrast potential Vc needs to have a desired value which secures a value equal to or greater than a predetermined value.

Further, a potential difference (blank portion contrast potential) Vb between the development bias potential Vdc and the dark portion potential Vd is a factor in determining what is called fogging (background soiling) amount at the blank portion of the paper P. If the blank portion contrast potential Vb becomes larger in excess of a predetermined value, reversely charged toner, that is, toner charged to positive polarity adheres as fogging to the blank portion of the paper P and becomes a trigger that causes an image soiling or contamination within the image forming apparatus. On the other hand, if the blank portion contrast potential Vb becomes smaller in excess of a predetermined value, normal charged toner, that is, toner charged to negative polarity becomes difficult to remove from the blank portion, and as a result, fogging occurs. Consequently, the blank portion contrast potential Vb needs to be set within a predetermined range.

First, a primary charging potential Vd0 is formed on the surface of the photosensitive drum 11 by the charging roller 12 which primarily charges the photosensitive drum 11. Then, in the image region, the laser exposure unit 20 performs exposure so that a difference between the surface potential of the photosensitive drum 11 and the development bias potential Vdc becomes a desired difference which allows supply of enough toner for image formation from the development roller 13 to the photosensitive drum 11. In the first exemplary embodiment, the laser exposure unit 20 controlled by the laser control unit performs exposure with the laser power E2 which causes an absolute value of a charging potential of the photosensitive drum 11 to drop (change) so that an electric potential on the image region of the photosensitive drum 11 becomes the light portion potential Vl. In the non-image region, the laser exposure unit 20 performs exposure so that the potential difference Vb between the surface potential of the photosensitive drum 11 and the development bias potential Vdc becomes a desired difference which does not allow supply of the toner from the development roller 13 to the photosensitive drum 11. In the first exemplary embodiment, the laser exposure unit 20 controlled by the laser control unit performs exposure with the laser power E1 which causes an absolute value of the charging potential of the photosensitive drum 11 to drop (change) so that an electric potential in the non-image region of the photosensitive drum 11 becomes the dark portion potential Vd.

Next, a specific example of potential setting for inhibiting fogging will be described. As described above, in the first exemplary embodiment, a primary charging bias (DC voltage) of −1100 (V) is applied to the charging roller 12, and a primary charging potential Vd0 of −500 (V) is formed on the surface of the photosensitive drum 11. As a specific example, the control unit 100 calculates a laser power E1 ($\mu J/cm^2$) required for obtaining −450 (V) as a desired dark portion potential Vd. Then, the laser exposure unit 20 controlled by the laser control unit, with which the control unit 100 is provided, forms a dark portion potential Vd of −450 (V) by exposing the non-image region of the surface of the photosensitive drum 11 with the laser power E1. Further, the laser control unit calculates a laser power E2 ($\mu J/cm^2$) required for obtaining −150 (V), as a desired light portion potential Vl. Then, the laser exposure unit 20 controlled by the laser control unit forms a light portion potential Vl of −150 (V) by exposing the image region of the surface of the photosensitive drum 11 with the laser power E2.

Figure 4:
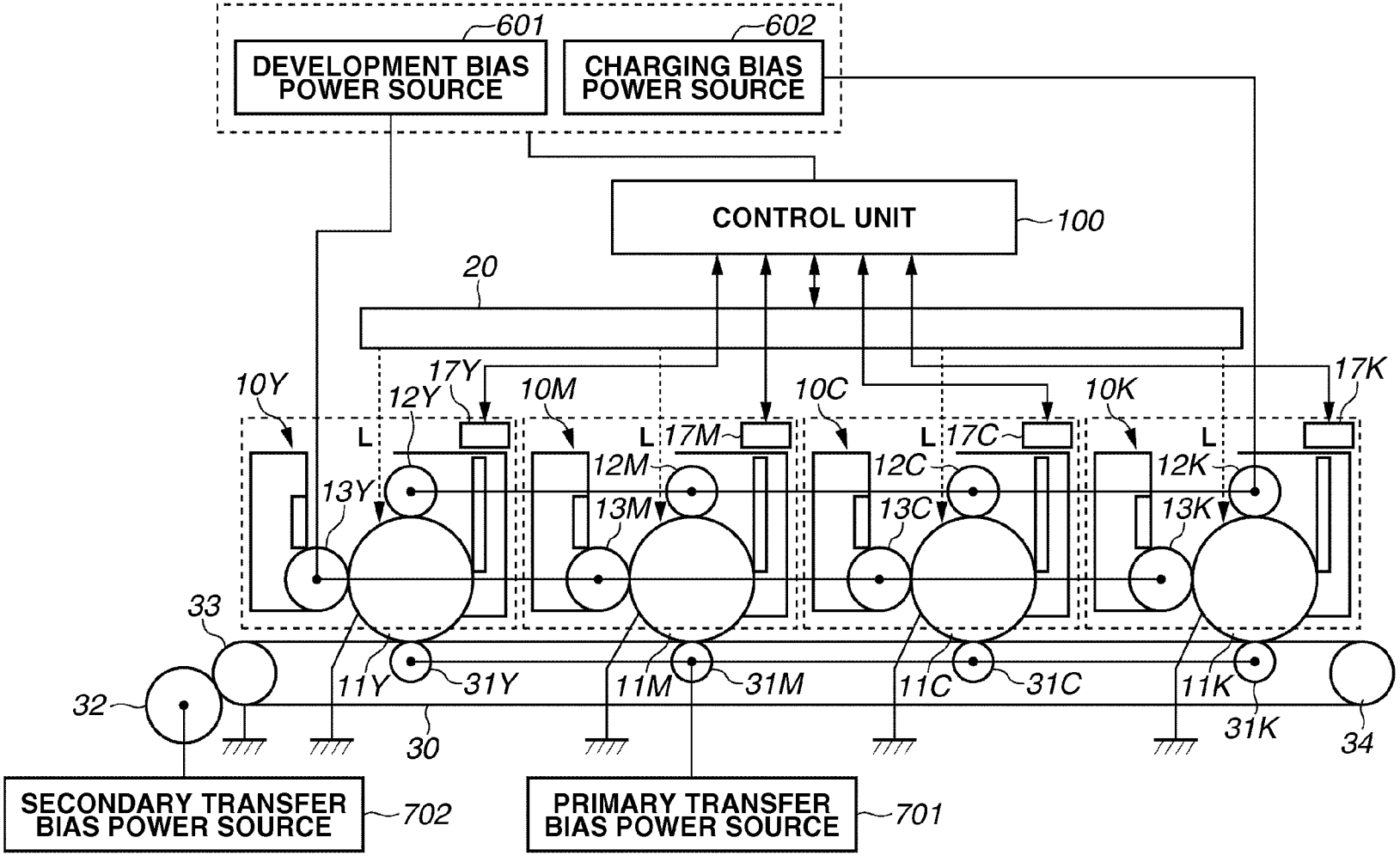
FIG. 4 is wiring diagram illustrating connections between respective power sources and respective process cartridges.

Next, a high-voltage power source circuit in the first exemplary embodiment will be described with reference to FIG. 4. FIG. 4 is a wiring diagram illustrating connections of a charging bias power source and a development bias power source with respective process cartridges, in the first exemplary embodiment. As illustrated in FIG. 4, a charging bias power source 602 as a first power source is connected to the charging rollers 12Y through 12K of respective process cartridges 10Y through 10K. In other words, power sources that apply charging biases to the charging rollers 12Y through 12K are one shared power source, and the primary charging biases of the same value are supplied to the charging rollers 12Y through 12K.

Further, similarly, as illustrated in FIG. 4, a development bias power source 601 as a second power source is connected to the development rollers 13Y through 13K of respective process cartridges 10Y through 10K. In other words, power sources that apply development biases to the development rollers 13Y through 13K are one shared power source, and development biases of the same value are supplied to the development rollers 13Y through 13K.

In this way, the image forming apparatus according to the first exemplary embodiment adopts a configuration of sharing the power sources for the charging rollers 12Y through 12K and the development rollers 13Y through 13K of the process cartridges 10Y through 10K as much as possible. By the sharing, reduction in size and reduction in cost of the image forming apparatus can be realized.

The image forming apparatus according to the first exemplary embodiment has two modes, that is, a full-color image formation mode (hereinafter, referred to as full-color mode) as a first mode to perform image formations with four colors, and a second mode (hereinafter, referred to as mono-mode) to perform image formation with mono color. Switching between the full-color mode and the mono-mode is controlled by a signal sent from the controller 200 to the control unit 100. During the mono-mode, since the above-described image formation operation is performed only in an image station of black K (hereinafter, referred to as black station), it is not necessary to perform image formations of yellow (Y), magenta (M), and cyan (C). Therefore, the development rollers 13Y, 13M, and 13C of the image stations of yellow (Y), magenta (M), and cyan (C) stand by in a state where they are spaced apart from the photosensitive drums 11Y, 11M, and 11C, and rotational drives are not transmitted. In other words, the development rollers 13Y, 13M, and 13C are in a stopped state. Since the photosensitive drums 11Y, 11M, and 11C other than the photosensitive drum 11K of the black (K) are in contact with the intermediate transfer belt 30, these drums are driven to rotate so that transfer memory due to sliding friction is not generated.

Figure 5A:
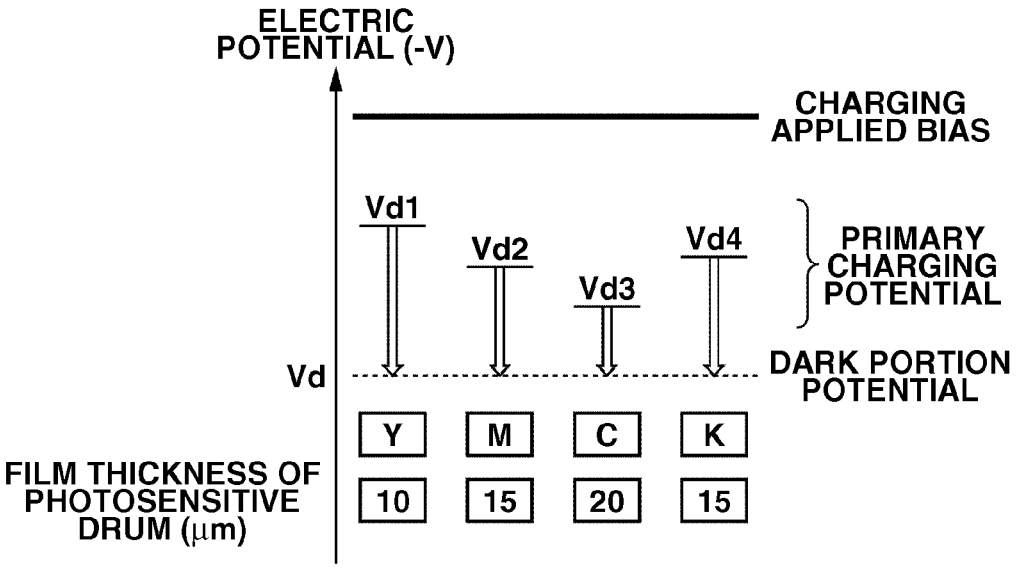
FIGS. 5A and 5B are diagrams schematically illustrating primary charging potential and dark portion potential and exposure control.
Figure 5B:
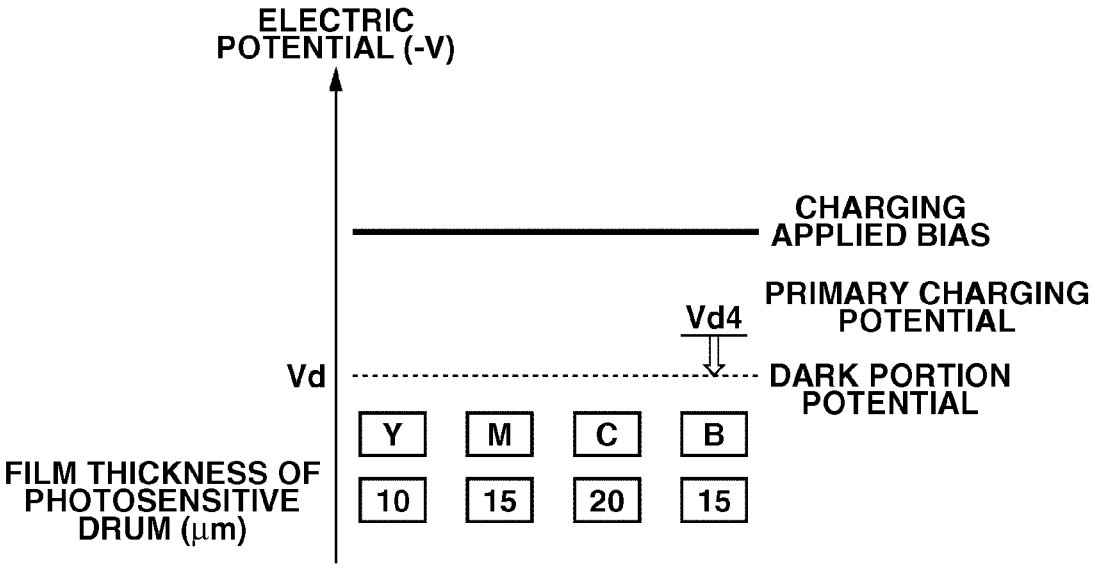

Next, primary charging potentials and exposure controls in respective modes in the first exemplary embodiment will be described with reference to FIG. 5. FIGS. 5A and 5B are diagrams schematically illustrating primary charging potentials and dark portion potentials, and exposure controls in the first exemplary embodiment. FIG. 5A is a diagram schematically illustrating the primary charging potential and the dark portion potential, and the exposure control in the full-color mode. FIG. 5B is a diagram schematically illustrating the primary charging potential and the dark portion potential, and the exposure control in the mono-mode. Like the image forming apparatus according to the first exemplary embodiment, in a configuration of sharing power sources that apply the charging biases to the charging rollers 12, only uniform primary charging bias at all image stations can be applied. On the other hand, states of the respective photosensitive drums 11 of the respective process cartridges 10 are not uniform depending on status of use, and film thicknesses are different from each other. Consequently, the primary charging potentials are different from each other in the respective photosensitive drums 11, and the primary charging potentials Vd1, Vd2, Vd3, and Vd4 are formed on the respective photosensitive drums 11Y through 11K, respectively.

Similarly, the image forming apparatus according to the first exemplary embodiment, since power sources that apply development biases to the development rollers 13 are shared, only uniform development biases can be applied at all image stations. Therefore, in the respective photosensitive drums 11, in a case where exposure has been performed with similar laser power, inevitably contrast potentials Vb in the blank portion is different for each of the photosensitive drums 11. In this way, when the blank portion contrast potentials Vb become inappropriate since they differ from each other, what is called fogging phenomenon in which the toner is developed even on the blank portion is likely to occur. Therefore, in the full-color mode, by performing background exposures, based on film thickness states of respective photosensitive drums 11, it is necessary to form the dark portion potential Vd from respective primary charging potentials Vd1, Vd2, Vd3, and Vd4.

For example, in a case where a film thickness of the photosensitive drum 11K of the process cartridge 10K in the full-color mode is 15 μm, it is necessary to set electric potentials such that the primary charging bias becomes −1100 (V), the primary charging potential becomes −550 (V), and the dark portion potential becomes −450 (V).

In other words, in the image forming apparatus according to the first exemplary embodiment in which power sources are shared as much as possible as described above, the background exposure needs to be carried out with such a laser power that constantly changes a potential in a range of 100 (V). Consequently, the photosensitive drum 11 is always exposed to a slightly stronger light amount of laser, and a charge transport layer and the underlying charge generation layer of the photosensitive drum 11 may be subjected to light fatigue. In other words, in addition to change in photosensitive layer film thickness, change (deterioration) in sensitivity caused by exposure occurs because of change in potential associated with repetitive use of the photosensitive drum 11. This is due to accumulation of remaining electric charges within the photosensitive layer, by repetition of exposure. A degree of the sensitivity change varies depending on laser power, exposure time, and exposure area, and the more energy cumulates by exposures, the more amount of electric charge remains.

In the photosensitive drum 11 which has been subjected to light fatigue, a phenomenon in which the development contrast potential Vc cannot be sufficiently secured, occurs, since sensitivity is deteriorated, and density of formed images becomes thin. Furthermore, a phenomenon what is called "fogging" in which a surface potential of the photosensitive drum 11 after being charged decays with time occurs, and a magnitude of contrast potential Vb in the blank portion cannot be sufficiently secured, thereby the toner may be developed even on the blank portion.

Further, a phenomenon in which the laser element is deteriorated occurs since light-emission time becomes longer when the background exposure is performed, resulting in the drop of light amount. Also in that case, there is a possibility that sufficient development contrast Vc cannot be secured, and density drops. Furthermore, in order to perform the background exposure, once, the surface potential of the photosensitive drum 11 needs to be set to a larger value toward a minus side than the dark portion potential Vd. Therefore, much more electric discharge amount than usual is required during the primary charging, and the surface of the photosensitive drum 11 is prone to deteriorate and is easily scraped off.

Thus, in the first exemplary embodiment, as illustrated in FIG. 5B, in order to reduce the background exposure amount as much as possible, it is made possible, during the mono-mode, to perform the background exposure with a laser power equal to or less than a first laser power during the full-color mode, or not to perform the background exposure. By doing so, during the mono-mode, light deterioration of the photosensitive drum 11 caused by exposure can be suppressed as much as possible, and worsening of sensitivity can be inhibited. Conventionally, a printing ratio of black (K) is the highest even in a color printer, and it is known that a number of print copies in the mono-mode tends to be increasing. Therefore, service life extension of the photosensitive drum 11K at the black station, and service life extension of the laser are a very important issue.

For example, when a film thickness of the photosensitive drum 11K of the process cartridge K is 15 μm, potential setting is made such that a charging bias is −1020 (V), a primary charging bias is −470 (V), and a dark portion potential is −450 (V). In other words, in the first exemplary embodiment during the mono-mode, a drop of an absolute value of the surface potential of the photosensitive drum 11 caused by the background exposure can be set to about 20 (V). In this way, by suppressing a primary charging potential and a magnitude of exposure amount as much as possible, light deterioration of the photosensitive drum 11 can be inhibited.

Figure 6:
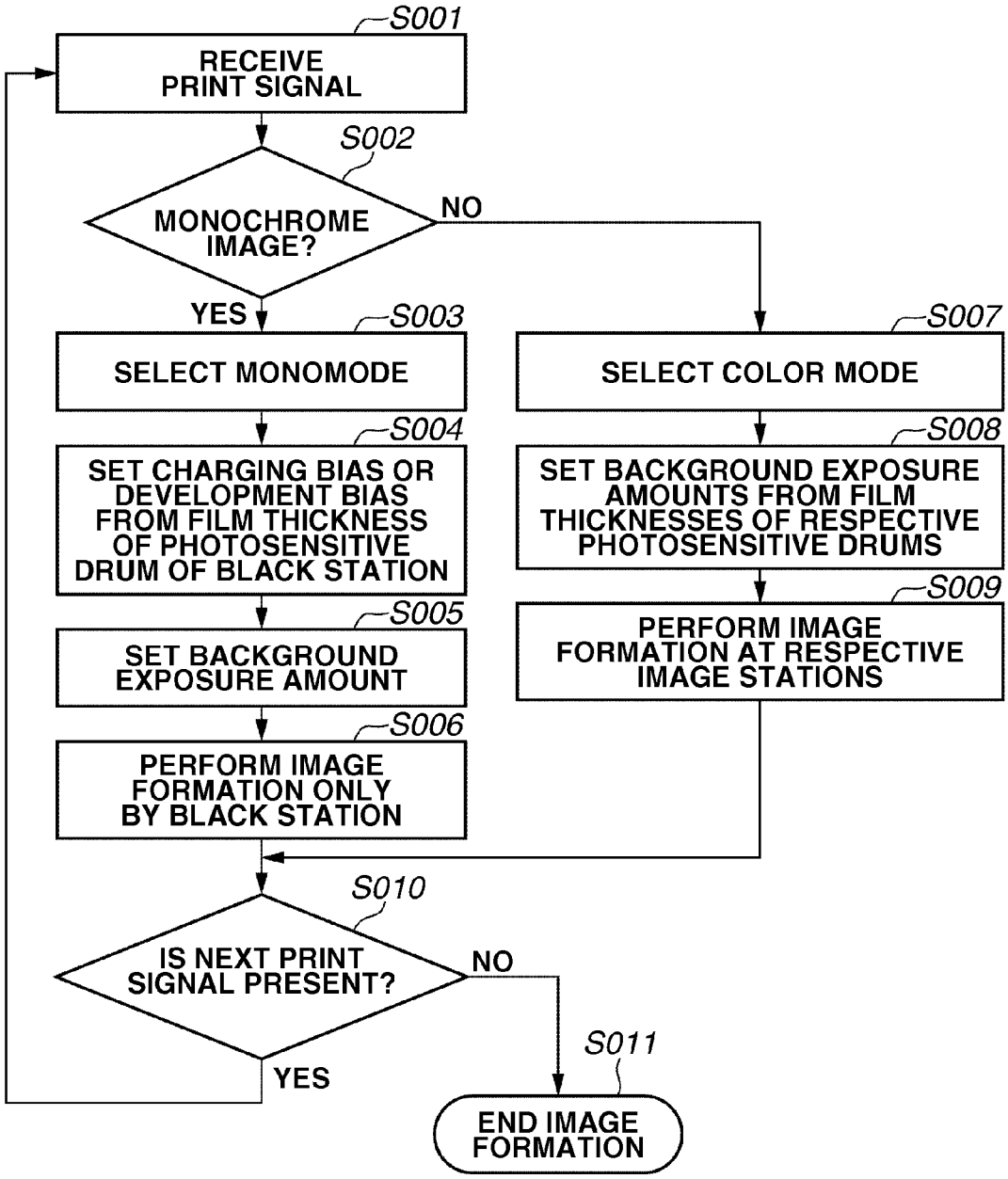
FIG. 6 is a flowchart diagram illustrating laser power control in the first exemplary embodiment.

Next, a laser power control method in the first exemplary embodiment will be described with reference to FIG. 6. FIG. 6 is a flowchart illustrating a laser power control in the first exemplary embodiment. As described above, it is only during the full-color mode that background exposure needs to be performed with strong light amount on the respective photosensitive drums 11. In other words, during the mono-mode, it is not necessary to perform ordinary background exposure control which is performed during the full-color mode. Hereinbelow, the details will be described with reference to FIG. 6.

First, in step S001, the control unit 100, with which the image forming apparatus main body 1 is provided, receives from the controller 200 a print signal (image signal) having print information (image information) for image formation. The print information contains information which enables determination whether an image to be formed is a color image or a monochrome image. In step S002, the control unit 100 determines whether the image to be formed is a monochrome image, based on the received print information. If the control unit 100 determines that the monochrome image is formed (YES in step S002), in step S003, the control unit 100 selects the mono-mode. If the control unit 100 determines that the color image is formed instead of the monochrome image (NO in step S002). Then, in step S007, the control unit 100 selects the color mode.

If the control unit 100 selects the mono-mode in step S003, in step S004, the control unit 100 sets a desired charging bias to be applied to the charging roller 12, based on a film thickness of the photosensitive drum 11K (the photosensitive drum for mono-mode). The desired charging bias refers to a bias which enables formation of the primary charging potential Vd4 of a minimum magnitude on the surface of the photosensitive drum 11K, which is necessary for changing a surface potential of the photosensitive drum 11K to the dark portion potential Vd, when the background exposure is performed. On that occasion, instead of the charging bias, a magnitude of the development bias to be applied to the development roller 13 may be controlled. After that, in step S005, the control unit 100 sets a background exposure amount corresponding to a film thickness of the photosensitive drum 11K. In the first exemplary embodiment, the control unit 100 sets a light amount of the first laser power E1 for forming the dark portion potential Vd to 0.02 ($\mu J/cm^2$). The control unit 100 sets a light amount of the second laser power E2 for forming the light portion potential Vl to 0.26 ($\mu J/cm^2$). Then, in step S006, the control unit 100, after setting a background exposure amount, performs image formation only at a black station. In the mono-mode in the first exemplary embodiment, a difference between the surface potential of the photosensitive drum 11K and the dark portion potential Vd becomes equal to or less than a predetermined magnitude, and a difference between the surface potential and the development bias potential Vdc may become nearly the same magnitude as the contrast potential Vb in the blank portion. At that time, a difference between the surface potential of the photosensitive drum 11K and the development bias potential Vdc falls within a predetermined range suitable for image formation. In such a case, even when the surface potential in the non-image region is not changed, fogging does not occur on the photosensitive drum 11 and there is no problem in image formation, and accordingly the background exposure needs not to be performed.

On the other hand, in step S007, the control unit 100 selects the color mode. Then, in step S008, the control unit 100 sets background exposure amounts based on film thicknesses of the respective photosensitive drums 11Y through 11K. For example, at the black station, the control unit 100 sets the first laser power E1 for forming the dark portion potential Vd to 0.05 ($\mu J/cm^2$), and sets the second laser power E2 for forming the light portion potential Vl to 0.3 ($\mu J/cm^2$). Then, in step S009, the control unit 100, after setting respective background exposure amounts, performs image formations at all image stations. Then, after image formation ends, in step S010, the control unit 100 determines whether the next print signal is present. If the print signal is present (YES in step S010), the control unit 100 repeats the above-described steps. If the print signal is not present (NO in step S010), in step S011, image formation operation ends.

By performing a control as described above, in the first exemplary embodiment, it has become possible to reduce a light-emission amount of the laser light, and to decrease an amount of light received by the photosensitive drum 11, while keeping quality of color images. Specifically, for example, in a case where printing is performed on a condition that a ratio of the mono-mode to the color mode is one half, as compared with conventional configuration, it has become possible to limit a light-emission amount of the laser light to about 30%. Accordingly, it becomes possible to prolong a service life of the laser element as a light source in the range of about 60 through 70%. Further, since an amount of light received by the photosensitive drum 11 can be similarly reduced, it becomes possible to inhibit sensitivity drop of the photosensitive drum 11.

Further, when 2500 copies each are printed in the mono-mode and in the color mode (total 5000 copies), the sensitivity drop was on the order of 10 (V), in the first exemplary embodiment, as compared with the sensitivity drop of the order of 30 (V) in the conventional configuration. Decay of the charging potential was also improved by decrease in an amount of light received by the photosensitive drum 11. Further, as for scraping of the surface of the photosensitive drum 11, improvement tendency on the order of about 20% could be confirmed.

As described above, in the first exemplary embodiment, during the mono-mode, primary charging biases are set based on a film thickness of the photosensitive drum 11K, and the primary charging biases lower than primary charging biases during the color mode are applied to the respective photosensitive drums 11. Consequently, decrease of film thicknesses and sensitivity drops of the respective photosensitive drums 11 can be inhibited. Further, in the first exemplary embodiment, during the mono-mode, inhibition of sensitivity drop of the photosensitive drum 11K, and service life extension of the light source can be realized, by reducing a laser power used to expose the photosensitive drum 11K.

An image forming apparatus according to a second exemplary embodiment, in the mono-mode, if print information received by the control unit 100 is only character information, the background exposure is not performed. On the other hand, in the mono-mode, if information of graphs or images instead of characters is contained in the print information, the background exposure is performed with weaker light amount than that in the color mode, similar to the first exemplary embodiment. Other configurations, for example, the photosensitive drums, the potential setting, and the high-voltage power source are similar to those in the first exemplary embodiment. The same reference numerals are used for the same configurations as the first exemplary embodiment, and descriptions thereof will not be repeated.

As described also in the first exemplary embodiment, performing the background exposure on the photosensitive drum 11 is effective from viewpoint of uniformity or stability of the charging. Further, service life extension of the photosensitive drum 11K at the black station, and service life extension of the laser is a very important issue. For this reason, during the mono-mode, performing the background exposure with a weaker exposure amount than that during the color mode, or not performing the background exposure is a very effective means for the above-described issue.

When service life extension of the photosensitive drums 11, service life extension of the light source, and uniformity, balance of stability of the charging are considered, it is said that switching the background exposure controls, based on image information during the mono-mode, is also an effective means. For example, in a case where print information is only character information, it is not necessary to perform the background exposure since there is no problem in terms of images. On the other hand, in a case of image information such as graphs or halftone images, performing the background exposure may be better in some cases from viewpoint of uniformity, stability of the charging.

Figure 7:
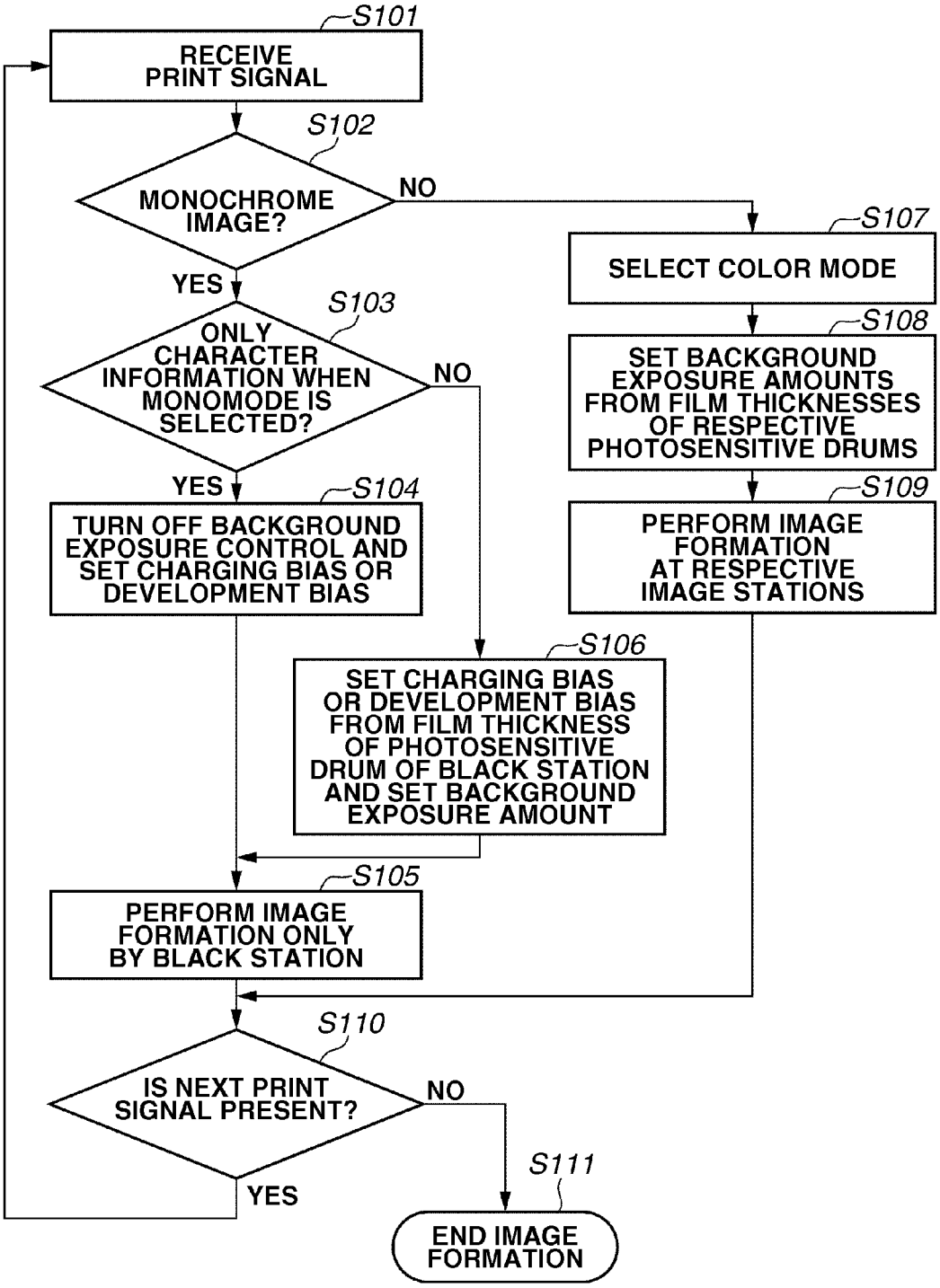
FIG. 7 is a flowchart diagram illustrating laser power control in a second exemplary embodiment.

A laser power control method in the second exemplary embodiment will be described with reference to FIG. 7. FIG. 7 is a flowchart illustrating a laser power control in the second exemplary embodiment. First, in step S101, the control unit 100, with which the image forming apparatus is provided, receives from the controller 200 a print signal (image signal) having print information (image information) for forming images. The print information contains information that enables determination whether an image to be formed is a color image or a monochrome image, and information that enables determination whether an image to be formed has only characters or images other than characters. In step S102, the control unit 100 determines whether an image to be formed is a monochrome image, based on the received print information. Then, if it is determined that the monochrome image is to be formed (YES in step S102), in step S103, the control unit 100 selects the mono-mode. If it is determined that the color image is to be formed (NO in step S102), in step S107, the control unit 100 selects the color mode instead of the monochrome image.

In step S103, if the mono-mode has been selected, at the same time, the control unit 100 determines whether the print information contains only character information. If it is determined that only character information is contained (YES in step S103), in step S104, the control unit 100 turns background exposure control off, and sets a desired charging bias for forming a light portion potential Vl to be applied to the charging rollers 12. On that occasion, the control unit 100 may control a magnitude of the development bias to be applied to the development rollers 13, instead of the charging bias. The second laser power E2 for forming the light portion potential Vl was set to 0.26 ($\mu J/cm^2$). After setting the background exposure amount in this way, in step S105, the control unit 100 executes image formation only at the black station.

On the other hand, if the mono-mode has been selected, and if it is determined that image information is contained (NO in step S103), in step S106, the control unit 100 sets a desired charging bias, based on a film thickness of the photosensitive drum 11K. The desired charging bias refers to a charging bias that can form on the surface of the photosensitive drum 11K the primary charging potential Vd4 of a minimum magnitude necessary for changing a surface potential of the photosensitive drum 11K to the dark portion potential Vd, when the background exposure is performed. At that time, instead of a charging bias, a development bias to be applied to the development rollers 13 may be controlled. At the same time, in step S106, the control unit 100 sets a background exposure amount. In the second exemplary embodiment, the first laser power E1 for forming the dark portion potential Vd was set to 0.02 ($\mu J/cm^2$). The second laser power E2 for forming the light portion potential Vl was set to 0.28 ($\mu J/cm^2$). After setting the background exposure amount in this way, in step S105, the control unit 100 executes image formation only at the black station.

If the control unit 100 has selected the color mode in step S107, then in step S108, the control unit 100 sets a background exposure amount based on film thicknesses of the respective photosensitive drums 11Y through 11K. For example, at the black station, the first laser power E1 for forming the dark portion potential Vd is set to 0.05 ($\mu J/cm^2$), and the second laser power E2 for forming the light portion potential Vl is set to 0.3 ($\mu J/cm^2$). After setting the background exposure amounts at all image stations, in step S109, the control unit 100 performs image formation at all image stations. After the image formation ends, in step S110, the control unit 100 determines whether the next print signal is present. If the print signal is present (YES in step S110), the control unit 100 repeats the above-described steps. If the print signal is not present (NO in step S110), in step S111, image formation operation ends.

By performing a control as described above, in the second exemplary embodiment, it has become possible to reduce a light-emission amount of the laser light, and to decrease an amount of light received by the photosensitive drum 11, while keeping quality of color images. Specifically, for example, when printing is performed on a condition that a ratio of the mono-mode to the color mode is one half, and a ratio of cases where only character information is contained, to cases where image information is contained in the mono-mode, is one half, a light-emission amount of the laser light could be reduced to about 40%, as compared with conventional configuration. Accordingly, it becomes possible to prolong a service life of the laser element in the range of about 50 to 60%. Further, since an amount of light received by the photosensitive drum 11 can be similarly reduced, it becomes possible to inhibit sensitivity drop of the photosensitive drum 11.

Further, when 2500 copies each are printed in the mono-mode and in the color mode (total 5000 copies), while the sensitivity drop on the order of 30 (V) occurred in the conventional configuration, the sensitivity drop was on the order of 15 (V) in the second exemplary embodiment. Decay of the charging potential was also improved by decrease in an amount of light received by the photosensitive drum 11. Further, as for scraping of the surface of the photosensitive drum 11, improvement tendency on the order of about 15% was confirmed.

As described above, in the second exemplary embodiment, during the mono-mode, the primary charging bias is set based on a film thickness of the photosensitive drum 11K, and the primary charging bias lower than the primary charging bias during the color mode is applied to the respective photosensitive drums 11. Consequently, decrease of film thicknesses and sensitivity drops of the respective photosensitive drums 11 can be inhibited. Further, in the second exemplary embodiment, during the mono-mode, inhibition of sensitivity drop of the photosensitive drum 11K, and service life extension of the light source can be realized, by reducing a laser power used to expose the photosensitive drum 11K. Furthermore, in the second exemplary embodiment, during the mono-mode, in a case where only character information is contained in the print information, since the background exposure is not performed, inhibition of sensitivity drop of the photosensitive drum 11K, and service life extension of the light source can be realized.

According to the present disclosure, deterioration of a photosensitive member serving as an image bearing member can be inhibited and a laser power of an exposure unit can be reduced.

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-098871 filed Apr. 24, 2012, which is hereby incorporated by reference herein in its entirety.

What is claimed is:

1. An image forming apparatus that forms an image on a recording material, the image forming apparatus comprising:

a plurality of image bearing members;

a plurality of charging devices each configured to charge a corresponding image bearing member, by the same charging bias supplied from a mutually shared first power source, and to form a predetermined charging potential on a surface of the image bearing member;

an exposure device configured to expose with a first laser power a non-image region to which a developer is not supplied from a developer bearing member, of a surface of the image bearing member to generate a non-image region potential, and to expose with a second laser power greater than the first laser power an image region to which developer is supplied from the developer bearing member to generate an image region potential;

a plurality of developer bearing members each configured to supply a developer to an image region of a corresponding image bearing member, on a surface of which a predetermined development potential is formed;

a storage device configured to acquire and store information about the plurality of image bearing members; and a control unit configured to control the charging bias, and the first laser power and the second laser power for each of the plurality of image bearing members, wherein the image forming apparatus is capable of executing a color mode for forming images of a plurality of colors using the plurality of developer bearing members, and a mono-mode for forming images of mono color using one developer bearing member of the plurality of developer bearing members, wherein the control unit, when the color mode is executed, determines the charging bias and, the first laser power and the second laser power for each of the plurality of image bearing members, based on information about the plurality of image bearing members, wherein the control unit, when the mono-mode is executed, determines the charging bias and, the first laser power and the second laser power for an image bearing member for the mono-mode, based on information about the image bearing member for the mono-mode, and wherein an absolute value of charging bias when the mono-mode is executed, is determined so as not to exceed an absolute value of charging bias when the color mode is executed.

2. The image forming apparatus according to claim 1, wherein when the mono-mode is executed, the first laser power for an image bearing member for the mono-mode is determined so as not to exceed a laser power set for the image bearing member for the mono-mode at a time of execution of the color mode, or, when the mono-mode is executed, exposure is not performed on a non-image region of the image bearing member for the mono-mode.

3. The image forming apparatus according to claim 1, wherein information about the image bearing member is information about film thickness of the image bearing member.

4. The image forming apparatus according to claim 1, wherein at a time of execution of the color mode, the control unit performs control in such a manner that the thinner the film thickness of an image bearing member is, the greater the first laser power for the image bearing member, which the control unit becomes.

5. The image forming apparatus according to claim 3, wherein the information about film thickness of the image bearing member is determined based on at least one of a number of image formations, a number of recording materials passing through the image forming apparatus, a number of revolutions of the image bearing member that is rotatably provided, and charging time of the image bearing member by a corresponding charging device.

6. The image forming apparatus according to claim 1, wherein each of the plurality of image bearing members is assembled into a cartridge configuration, and is detachably mountable to an apparatus main body of the image forming apparatus.

7. The image forming apparatus according to claim 1, wherein in a case where image formation is performed in the mono-mode, when a charging potential formed on a surface of the image bearing member for the mono-mode falls in a predetermined range, the exposure device does not perform exposure on a non-image region of the image bearing member for the mono-mode.

8. The image forming apparatus according to claim 1, wherein in a case where only image formation of characters is performed in the mono-mode, exposure is not performed on a non-image region of the image bearing member for the mono-mode.

9. The image forming apparatus according to claim 1, wherein, the plurality of developer bearing members is supplied with the same development bias from a mutually shared second power source.

10. The image forming apparatus according to claim 1, wherein in a case where the charging bias becomes smaller when the mono-mode is executed than when the color mode is executed, the first laser power for the image bearing member for the mono-mode becomes smaller than the first laser power of when the color mode is executed at a time of execution of the mono-mode.

11. An image forming apparatus that forms an image on a recording material, the image forming apparatus comprising:

a plurality of image bearing members;

a plurality of charging devices each configured to charge a corresponding image bearing member, by the same charging bias supplied from a mutually shared first power source, and to form a predetermined charging potential on a surface of the image bearing member;

an exposure device configured to expose with a first laser power a non-image region to which a developer is not supplied from a developer bearing member, of a surface of the image bearing member to generate a non-image region potential, and to expose with a second laser power greater than a first laser power an image region to which developer is supplied from the developer bearing member to generate an image region potential;

a plurality of developer bearing members each configured to supply a developer to an image region of a corresponding image bearing member, on a surface of which a predetermined development potential is formed;

a storage device configured to acquire and store information about the plurality of image bearing members; and a control unit configured to control the charging bias, and the first laser power and the second laser power for each of the plurality of image bearing members, wherein the image forming apparatus is capable of executing a color mode for forming images of a plurality of colors using the plurality of developer bearing members, and a mono-mode for forming images of mono color using one developer bearing member of the plurality of developer bearing members, and wherein the control unit, when the color mode is executed, determines the charging bias and, the first laser power and the second laser power for each of the plurality of image bearing members, based on information about the plurality of image bearing members, wherein the control unit, when the mono-mode is executed, determines the charging bias and, the first laser power and the second laser power for an image bearing member for the mono-mode, based on information about the image bearing member for the mono-mode, and wherein in a case where image formation is performed in the mono-mode, when a charging potential formed on a surface of the image bearing member for the mono-mode falls in a predetermined range, the exposure device does not perform exposure on a non-image region of the image bearing member for the mono-mode.

12. An image forming apparatus that forms an image on a recording material, the image forming apparatus comprising:

a plurality of image bearing members;

a plurality of charging devices each configured to charge a corresponding image bearing member, by the same charging bias supplied from a mutually shared first power source, and to form a predetermined charging potential on a surface of the image bearing member;

an exposure device configured to expose with a first laser power a non-image region to which a developer is not supplied from a developer bearing member, of a surface of the image bearing member to generate a non-image region potential, and to expose with a second laser power greater than a first laser power an image region to which developer is supplied from the developer bearing member to generate an image region potential;

a plurality of developer bearing members each configured to supply a developer to an image region of a corresponding image bearing member, on a surface of which a predetermined development potential is formed;

a storage device configured to acquire and store information about the plurality of image bearing members; and a control unit configured to control the charging bias, and the first laser power and the second laser power for each of the plurality of image bearing members, wherein the image forming apparatus is capable of executing a color mode for forming images of a plurality of colors using the plurality of developer bearing members, and a mono-mode for forming images of mono color using one developer bearing member of the plurality of developer bearing members, and wherein the control unit, when the color mode is executed, determines the charging bias and, the first laser power and the second laser power for each of the plurality of image bearing members, based on information about the plurality of image bearing members, wherein the control unit, when the mono-mode is executed, determines the charging bias and, the first laser power and the second laser power for an image bearing member for the mono-mode, based on information about the image bearing member for the mono-mode, and wherein in a case where only image formation of characters is performed in the mono-mode, exposure is not performed on a non-image region of the image bearing member for the mono-mode.

* * * * *